US005590436A

United States Patent [19]

Wright et al.

[11] Patent Number: 5,590,436

[45] Date of Patent: Jan. 7, 1997

[54] TOOTHBRUSH

[75] Inventors: John R. Wright, Morpeth, United Kingdom; David Balkwill, Nantes, France

[73] Assignee: Prelude UK Limited, Newcastle upon Tyne, United Kingdom

[21] Appl. No.: 450,954

[22] Filed: May 23, 1995

[30] Foreign Application Priority Data

Apr. 7, 1995 [GB] United Kingdom ..... 9507295

[51] Int. Cl.[6] ..... A46B 5/02; A46B 9/04

[52] U.S. Cl. ..... 15/105; 15/143.1; 15/167.1; 15/246; 446/73; D4/107

[58] Field of Search ..... 15/105, 143.1, 15/167.1; 248/110, 111; 446/73, 97; D4/107, 124, 125, 126, 138

[56] References Cited

U.S. PATENT DOCUMENTS

| | | | |
|---|---|---|---|
| 2,539,035 | 1/1951 | Scanlon | 248/110 |
| 2,603,810 | 7/1952 | Duhme | 15/246 |
| 2,823,490 | 2/1958 | Griem | 446/73 |
| 3,170,265 | 2/1965 | Goldfarb | 248/111 |
| 5,187,829 | 2/1993 | Atkins | 15/167.1 |
| 5,261,847 | 11/1993 | Cox | D4/125 |
| 5,269,420 | 12/1993 | Harrison | 248/110 |
| 5,353,464 | 10/1994 | Atkins et al. . | |
| 5,444,889 | 8/1995 | Barre | 15/167.1 |

FOREIGN PATENT DOCUMENTS

| | | | |
|---|---|---|---|
| 0611533 | 8/1994 | European Pat. Off. | 15/167.1 |
| 2495908 | 12/1980 | France . | |
| 7143294 | 3/1972 | Germany . | |
| 3236618 | 4/1984 | Germany | 15/167.1 |
| 8912819 | 2/1990 | Germany . | |
| 2230942 | 11/1990 | United Kingdom | 15/167.1 |
| 9310688 | 6/1993 | WIPO . | |
| 9424916 | 11/1994 | WIPO . | |

*Primary Examiner*—David Scherbel
*Assistant Examiner*—Randall E. Chin
*Attorney, Agent, or Firm*—Leydig, Voit & Mayer

[57] ABSTRACT

A toothbrush having a handle which carries a figurine formed separately from but attached to the handle. The figurine can be attached directly to the handle of the toothbrush or can be attached first to a carrier which is then attached to the handle. The toothbrush is also capable of being supported at an angle to a surface by supporting means provided on the handle.

14 Claims, 4 Drawing Sheets

TOOTHBRUSH

BACKGROUND OF THE INVENTION

The invention relates generally to toothbrushes.

SUMMARY OF THE INVENTION

According to the invention there is provided a toothbrush comprising a head portion, a handle portion and a base portion in which the handle portion carries a figurine which is formed separately from the handle and is attached thereto.

According to the invention there is also provided a toothbrush comprising a head portion, and a handle portion in which the handle portion is provided with means for supporting the toothbrush on a surface so that the toothbrush extends at an angle to said surface.

According to the invention there is further provided a toothbrush comprising a longitudinally extending handle portion with two ends and two elongate sides, one end provided with an arcuately curved, integrally formed head portion on the first side of the handle and the other end provided with integrally formed means for supporting the toothbrush on a surface with the handle extending away from the surface at an angle to the surface, the handle portion carrying a figurine which is formed separately from the handle and is attached on the first side of the handle.

DESCRIPTION OF THE DRAWINGS

Exemplary embodiments of a toothbrush in accordance with the present invention will now be described, by way of example only, with reference to the accompanying diagrammatic drawings in which.

DESCRIPTION OF PREFERRED EMBODIMENTS

Figure 1:
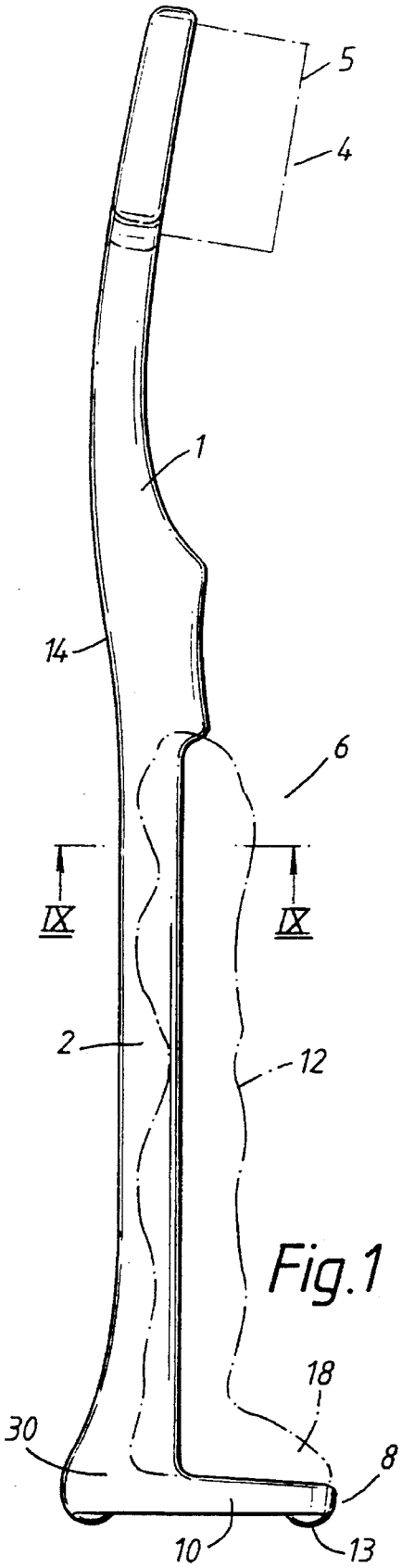
FIG. 1 is a side elevation of a toothbrush in accordance with the invention.
Figure 2:
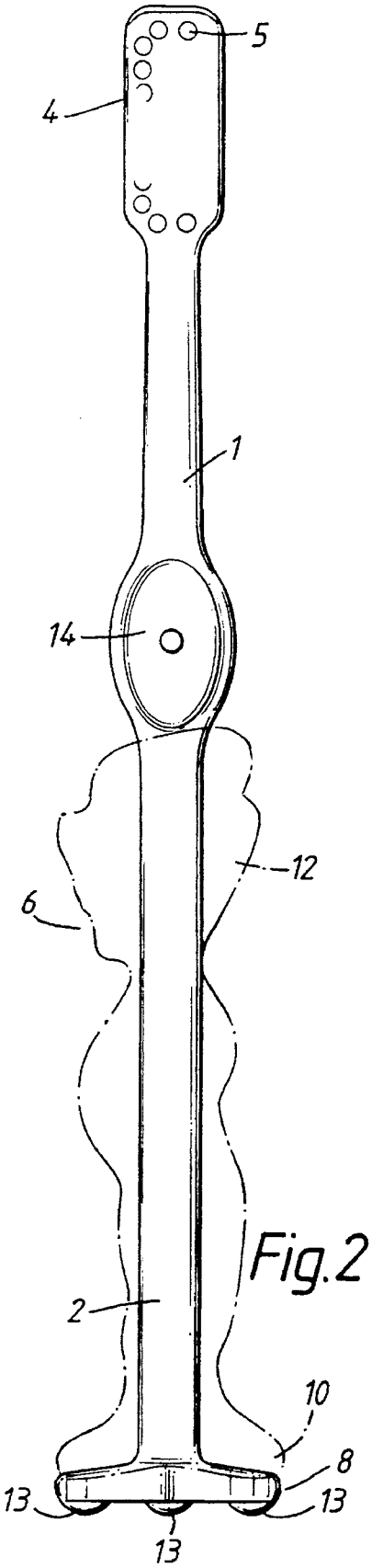
FIG. 2 is a front elevation of the toothbrush of FIG. 1.

The toothbrush 1 of FIGS. 1 to 5 comprises a handle 2 which, towards one end, is arcuately curved. A profiled head portion 4 is carried at the end of the curved portion. Conventional toothbrush bristles (outlined at 5) are mounted on the head portion 4 in a standard layout as represented in FIG. 2.

The other end of the handle is provided with a Y-shaped stand 10 lying in a plane generally normal to the length of the handle. The stand 10 is formed by a widened foot 30 at the end of the handle 2 and two limbs 11 extending from an end of the foot on the same side of the handle 2 as the bristles

Figure 3:
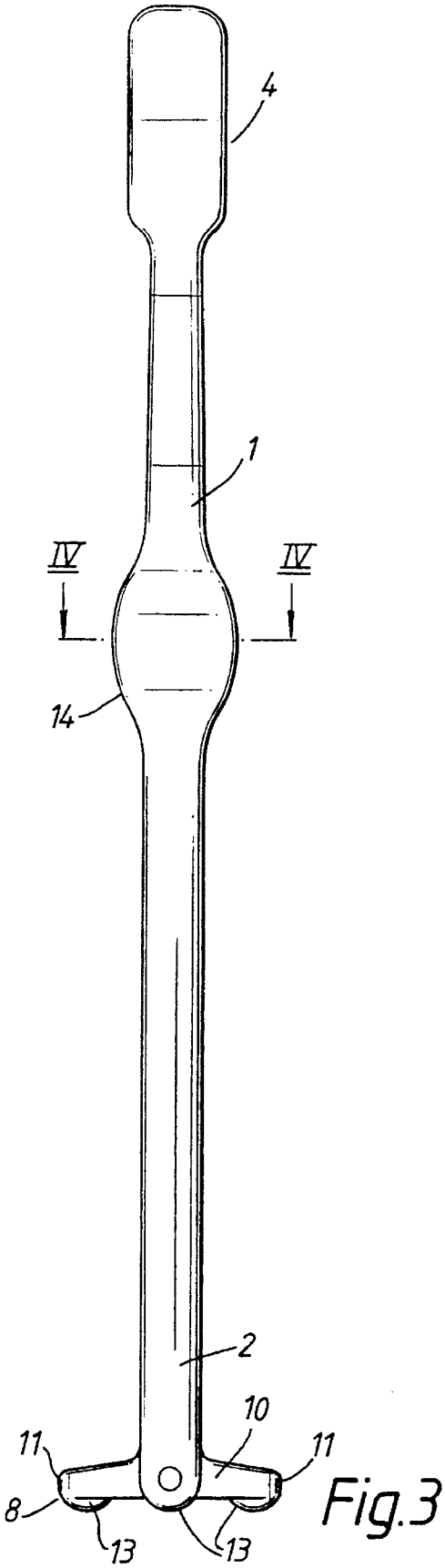
FIG. 3 is a rear elevation of the toothbrush of FIGS. 1 and 2.
Figure 4:
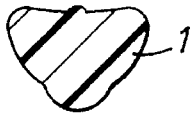
FIG. 4 is a cross-sectional view taken on the line IV—IV in FIG. 3.
Figure 5:
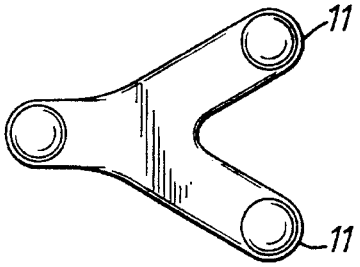
FIG. 5 is a plan view of the base of the toothbrush of FIGS. 1 to 4.

5. The limbs 11 are co-planar and the angle between these limbs 11 is about 60°. The end of the handle 2 and the ends 13 of the limbs 11 project beyond the plane of the limbs 11 to provide a tripod-like support on which the toothbrush 1 can stand on a surface with the handle 2 generally normal to the plane of the surface. The central part of the handle 2 is profiled to form a mounting for figurine 12. The term "figurine" is intended to include representations of both real or imaginary figures and inanimate objects. The figurine 12, as shown in FIGS. 1 to 3, is provided with a head portion and feet 18. The figurine 12 is glued to the handle 2. However, the body 2 may be provided with a hemispherically shaped recess 14 into which the head of the figurine 12 may be secured, for example, by a snap fit. It will be appreciated that the head may be fixed by any other suitable means. The body 2 of the toothbrush 1 may be appropriately shaped to snap-fit around the remainder of the figurine 12 or alternatively the figurine 12 may be appropriately shaped to snap-fit around the body 2 of the toothbrush 1. The feet 18 of the figurine 12 may rest on the limbs 11.

It will be appreciated that the angle between the limbs 11 need not be 60° and can be varied. Also the stand 10 need not be Y-shaped and need not be situated at the end of the handle 2 furthest from the bristles 5. For example, the stand may be wedge shaped and situated between the bristles 5 and the handle end 2 on the side of the handle opposite the character 12. In this way, the toothbrush would be supported by the stand with the handle inclined at an acute angle relative to a supporting surface, with the head 4 uppermost and the figurine 12 facing upwardly.

Figure 6:
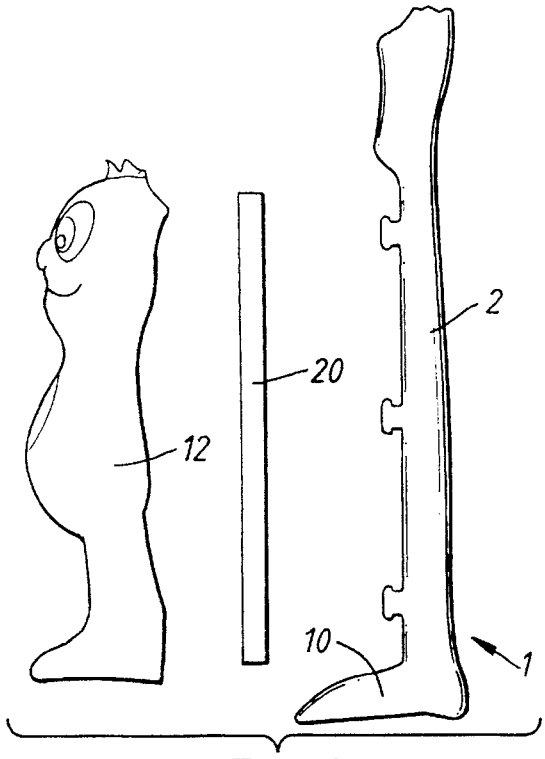
FIG. 6 is a side elevation of a second form of toothbrush.

Further embodiments of the invention are shown in FIGS. 6, 7, 8 and 9 in which parts corresponding to parts in FIGS. 1 to 5 are correspondingly numbered and are not described in detail. FIG. 6 shows a modified method of attaching the figurine 12 to the body 2. The figurine 12 is first attached to a carrier 20 which is elongate and of generally rectangular cross-section and which in turn is attached to the body 2 of the toothbrush 1. The figurine 12 may be adhesively fixed to the carrier 20 and then the carrier 20 mechanically fixed to the body 2, as shown, by a series of integrally formed pegs and sockets. There are many other methods of attaching the figurine 12 to the carrier 20 and the carrier 20 to the body 2. For example, one or more co-operating snap-fit pegs and sockets may be used or one or more screws may be used. The figurine 12 may be provided with integrally formed sockets to snap-fit with the pegs.

Figure 7:
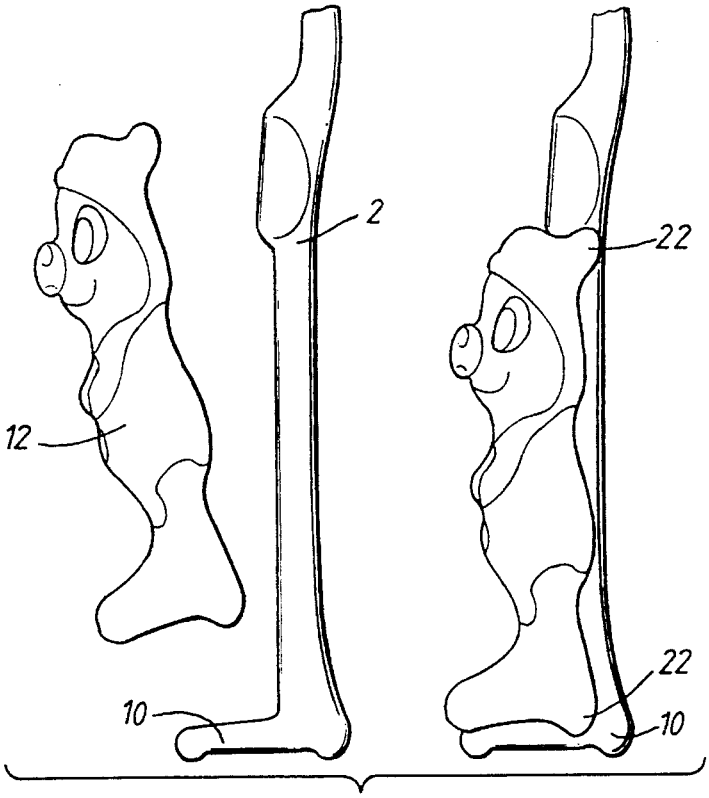
FIG. 7 is a side elevation of a third form of toothbrush.

FIG. 7 shows a further arrangement for fixing the figurine 12 to the body 2 of the toothbrush 1. In this example, features 22 of the figurine 12, such as the ears, hat or feet, are formed so as to snap-fit onto shaped parts of the body 2 of the toothbrush 1. In this example, the hat has ears than snap-fit on either side of a shaped part of the handle and the feet have lugs that fit onto the base 10.

Figure 8:
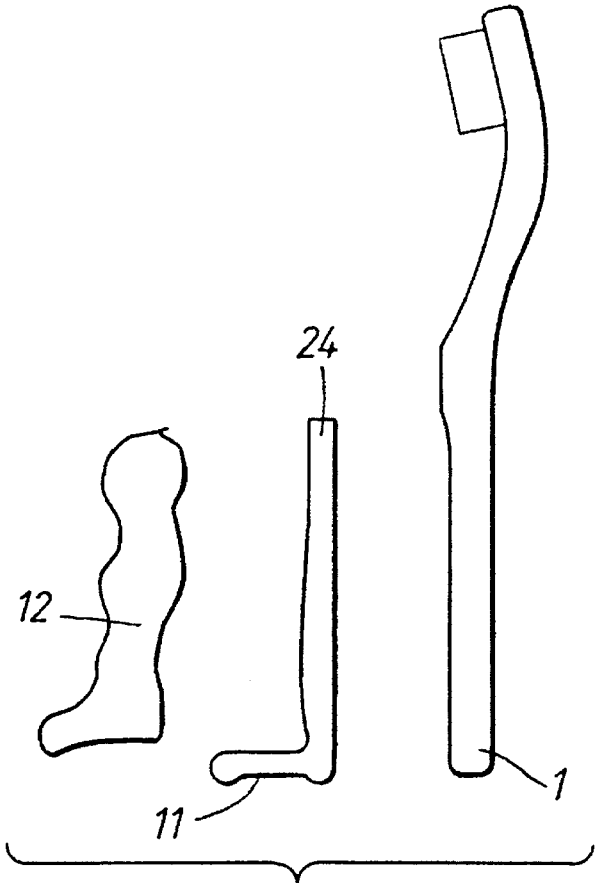
FIG. 8 is a side elevation of a fourth form of toothbrush.

FIG. 8 shows another arrangement similar to that of FIG. 6. In this case, however, a carrier 24 is provided with the stand 10 including the limbs 11, which enable the toothbrush 1 to stand. The carrier 24 can then be fitted to a more conventionally shaped toothbrush by adhesive or other methods.

Figure 9:
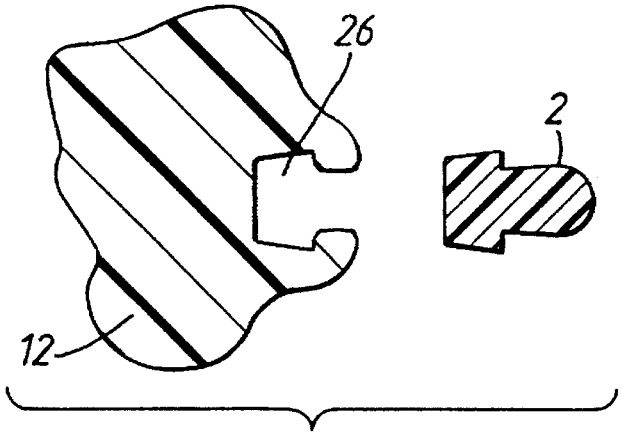
FIG. 9 is a cross-sectional view of a fifth form of toothbrush; the position of the section on this toothbrush is indicated by the lines IX—IX in FIG. 1 (although the section is different from the section on this line in FIG. 1).

FIG. 9 shows a further method of attaching the figurine 12 to the body 2 of the toothbrush 1 in which the figurine 12 is provided with a shaped slot 26 along its length to slidingly receive a corresponding shaped portion of the length of the handle 2.

It will be appreciated that there are many other methods of attaching the figurine 12 to the body 2 of the toothbrush 1.

The outwardly extending limbs 11 of the base portion 8 may be omitted and the feet 18 of the figurine 12 may form the stand 10 for the toothbrush 1.

The toothbrush 1 may be formed from resilient material such as a plastics material manufactured by, for example, an injection moulding technique.

What is claimed is:

1. A toothbrush comprising a handle having a first end;

a second end;

a central portion extending from said second end towards said first end to provide a manual grip in use of the toothbrush;

a further portion extending between said central portion and said first end;

a head portion carried at said first end of the handle;

bristles provided on said head portion;

mounting means provided on said central portion;

a separately formed figurine carried by said mounting means and extending from adjacent said second end and along said central portion; and a stand portion extending from said handle to provide means for supporting the toothbrush on a surface so that the handle extends in a substantially upright orientation relative to said surface, the stand portion comprising a plurality of co-planar, outwardly extending limbs.

2. The toothbrush according to claim 1, wherein the limbs are arranged in a Y-shape.

3. The toothbrush according to claim 1 wherein the angle between two of the limbs is 60°.

4. The toothbrush according to claim 1 wherein the figurine is a releasable snap-fit onto the handle.

5. The toothbrush according to claim 1 wherein the figurine is fixedly attached to the handle.

6. The toothbrush according to claim 5 wherein the figurine is attached by an adhesive.

7. The toothbrush according to claim 1 wherein the mounting means includes a carrier and the carrier is connected to the handle.

8. A toothbrush comprising a handle having a first end;

a second end;

a central portion extending from said second end towards said first end to provide a manual grip in use of the toothbrush;

a further portion extending between said central portion and said first end;

a head portion carried at said first end of the handle;

bristles provided on said head portion;

mounting means provided on said central portion;

a separately formed figurine carried by said mounting means and extending from adjacent said second end and along said central portion, and co-planar outwardly excluding feet formed on the figurine and providing a stand portion for supporting the toothbrush in a substantially upright orientation relative to a surface.

9. The toothbrush according to claim 8 wherein the figurine is a releasable snap-fit onto the handle.

10. The toothbrush according to claim 8 wherein the figurine is fixedly attached to the handle.

11. The toothbrush according to claim 10 wherein the figurine is attached is by an adhesive.

12. The toothbrush according to claim 8 wherein the mounting means includes is mounted on a carrier and the carrier is connected to the handle.

13. A toothbrush comprising a handle oriented substantially upright and having a first end;

a second end;

a central portion extending from said second end towards said first end to provide a manual grip in use of the toothbrush;

a further portion extending between said central portion and said first end;

a head portion carried at said first end of the handle;

bristles provided on said head portion;

mounting means provided on said central portion, said mounting means including a shaped portion provided on said handle;

a separately formed figurine carried by said mounting means, said figurine provided with a slot and which is a sliding fit around the shaped portion whereby the figurine extends from adjacent said second end and along said central portion.

14. A toothbrush comprising;

a handle having;

a first end;

a second end;

a central portion extending from said second end towards said first end to provide a manual grip in use of the toothbrush, the central portion being provided with mounting means;

a further portion extending between said central portion and said first end;

a head portion carried at said first end of the handle;

bristles provided on said head portion;

a stand portion extending from said handle to provide means for supporting the toothbrush in a substantially upright orientation relative to a surface so that the handle extends at an angle to said surface;

a separately formed figurine carried by said mounting means and extending from adjacent said second end and along said central portion, wherein the mounting means includes a slot in the figurine and the handle is provided with a shaped portion which is a sliding fit in the slot.

* * * * *

UNITED STATES PATENT AND TRADEMARK OFFICE

CERTIFICATE OF CORRECTION

PATENT NO. : 5,590,436

DATED : January 7, 1997

INVENTOR(S) : Wright et al.

It is certified that error appears in the above-indentified patent and that said Letters Patent is hereby corrected as shown below:

Column 4, Line 9, after "attached" delete --is--;

Line 11, after "includes" delete --is mounted on--.

Signed and Sealed this

Twentieth Day of May, 1997

Bruce Lehman

*Attest:*

BRUCE LEHMAN

*Attesting Officer*

*Commissioner of Patents and Trademarks*